US011763982B2

(12) United States Patent
Lee et al.

(10) Patent No.: US 11,763,982 B2
(45) Date of Patent: Sep. 19, 2023

(54) INDUCTOR AND MANUFACTURING METHOD THEREOF

(71) Applicant: SAMSUNG ELECTRO-MECHANICS CO., LTD., Suwon-si (KR)

(72) Inventors: Sa Yong Lee, Suwon-Si (KR); Mi Sun Hwang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 544 days.

(21) Appl. No.: 16/206,582

(22) Filed: Nov. 30, 2018

(65) Prior Publication Data

US 2019/0318867 A1 Oct. 17, 2019

(30) Foreign Application Priority Data

Apr. 12, 2018 (KR) ..... 10-2018-0042759

(51) Int. Cl.

| | |
|---|---|
| ***H01F 27/32*** | (2006.01) |
| ***H01F 5/06*** | (2006.01) |
| ***H01F 27/29*** | (2006.01) |
| ***H01F 41/12*** | (2006.01) |

(52) U.S. Cl.

CPC ..... *H01F 27/32* (2013.01); *H01F 5/06* (2013.01); *H01F 27/29* (2013.01); *H01F 41/12* (2013.01)

(58) Field of Classification Search

CPC . H01F 27/29; H01F 27/32; H01F 5/06; H01F 41/12

See application file for complete search history.

(56) References Cited

U.S. PATENT DOCUMENTS

| | | | | |
|---|---|---|---|---|
| 10,312,014 | B2 * | 6/2019 | Lee | H01F 27/292 |
| 2008/0157913 | A1 | 7/2008 | Kim | |
| 2008/0257488 | A1 * | 10/2008 | Yamano | H01F 41/122 156/274.2 |
| 2011/0074535 | A1 | 3/2011 | Banno | |

(Continued)

FOREIGN PATENT DOCUMENTS

| | | |
|---|---|---|
| JP | 1998-303037 | 11/1998 |
| JP | 2011-077157 A | 4/2011 |

(Continued)

OTHER PUBLICATIONS

"Lee, Inductor with Improved Inductance for Miniaturization and Method of Manufacturing the Same, Feb. 1, 2017" (Year: 2017).*

(Continued)

*Primary Examiner* — Marlon T Fletcher
*Assistant Examiner* — Malcolm Barnes
(74) *Attorney, Agent, or Firm* — Morgan, Lewis & Bockius LLP

(57) ABSTRACT

An inductor includes a body in which a plurality of insulating layers on which a plurality of coil patterns are arranged are stacked, and first and second external electrodes disposed inside the body, wherein the plurality of coil patterns are connected by coil connecting portions and form a coil in which opposing ends thereof are connected to the first and second external electrodes, and the first and second external electrodes are directly connected to the opposing ends of the plurality of coil patterns inside the body.

15 Claims, 9 Drawing Sheets

(56) References Cited

U.S. PATENT DOCUMENTS

| | | | | |
|---|---|---|---|---|
| 2014/0049353 | A1 | 2/2014 | Yoon et al. | |
| 2014/0375412 | A1* | 12/2014 | Seko | H01F 27/292 336/200 |
| 2015/0009003 | A1* | 1/2015 | Ozawa | H01F 17/0013 336/200 |
| 2015/0091685 | A1* | 4/2015 | Kitajima | H01F 41/041 336/192 |
| 2016/0042858 | A1* | 2/2016 | Park | H01F 41/041 336/200 |
| 2016/0099100 | A1* | 4/2016 | Park | H01F 17/0013 336/200 |
| 2016/0268038 | A1* | 9/2016 | Choi | H01F 27/255 |
| 2017/0053732 | A1* | 2/2017 | Moon | H01F 27/292 |
| 2017/0133146 | A1 | 5/2017 | Lee | |
| 2017/0278624 | A1* | 9/2017 | Ogino | H01F 27/32 |
| 2018/0047498 | A1* | 2/2018 | Nakashima | H01F 17/0013 |
| 2018/0233280 | A1* | 8/2018 | Ishima | H01F 27/2804 |
| 2019/0088396 | A1* | 3/2019 | Nakashima | H01F 17/0013 |
| 2019/0096569 | A1* | 3/2019 | Tanabe | H01F 41/041 |
| 2019/0189333 | A1* | 6/2019 | Kido | H01F 27/29 |
| 2019/0311832 | A1* | 10/2019 | Tanabe | H01G 4/30 |

FOREIGN PATENT DOCUMENTS

| | | | |
|---|---|---|---|
| JP | 2013-098554 | A | 5/2013 |
| JP | 2013-191863 | A | 9/2013 |
| JP | 2014-39036 | A | 2/2014 |
| JP | 2015-70122 | A | 4/2015 |
| JP | 2017-92447 | A | 5/2017 |
| KR | 10-0869741 | B1 | 11/2008 |
| KR | 10-2017-0053913 | A | 5/2017 |

OTHER PUBLICATIONS

Office Action issued in corresponding Japanese Application No. 2018-228747, dated May 28, 2019.

Office Action issued in Japanese Patent Application No. 2018-228747 dated Nov. 12, 2019, with English translation.

Office Action issued in corresponding Korean Application No. 10-2018-0042759, dated Apr. 30, 2019.

* cited by examiner

INDUCTOR AND MANUFACTURING METHOD THEREOF

CROSS-REFERENCE TO RELATED APPLICATION

This application claims the benefit of priority to Korean Patent Application No. 10-2018-0042759 filed on Apr. 12, 2018, in the Korean Intellectual Property Office, the disclosure of which is incorporated herein by reference in its entirety.

TECHNICAL FIELD

The present disclosure relates to an inductor and a manufacturing method thereof.

BACKGROUND

Recently, smartphones have been implemented with the ability to use many frequency bands due to the application of multiband long term evolution (LTE). As a result, high frequency inductors are largely used as impedance matching circuits in signal transmission and reception RF systems. The high frequency inductors are required to have a smaller size and higher capacity. Also, in the progress toward 5G, the necessity of passive elements operating in high frequency bands of tens of GHz is on the increase.

In order to obtain an impedance/signal matching inductor capable of realizing high inductance and low direct current (DC) resistance, a structure capable of improving inductance and Q characteristics is required.

The related art chip inductors are multilayer type inductors manufactured by stacking insulating layers on which an electrode pattern is formed and connecting lines of the layers by via holes.

The related art impedance matching inductors are manufactured in two ways.

In a first scheme, a multilayer body continued in a coil layer-via layer-coil layer manner is formed using a photosensitive paste and sintered, and in this method, shapes of coils and vias are not smooth. In this case, resistance is increased due to a skin effect and high Q characteristics cannot be obtained in a high frequency region.

The second is a thin film multilayer inductor, which includes a metal coil and an organic body and has roughness on a surface of a coil pattern to improve bonding force between the organic body and the coil.

The roughness formed on the surface of the coil pattern may increase resistance in a high frequency region and cannot obtain high Q characteristics in a high frequency region.

In particular, since external electrodes are disposed on an external surface of a body, a volume of the body is reduced by an amount equal to a volume of the external electrodes, causing a problem in realizing high inductance.

SUMMARY

An aspect of the present disclosure may provide an inductor having high inductance and high Q characteristics.

According to an aspect of the present disclosure, an inductor may include: a body in which a plurality of insulating layers on which a plurality of coil patterns are arranged are stacked; and first and second external electrodes disposed inside the body, wherein the plurality of coil patterns are connected by coil connecting portions and form a coil in which opposing ends thereof are connected to the first and second external electrodes, and the first and second external electrodes are directly connected to the opposing ends of the plurality of coil patterns inside the body.

According to another aspect of the present disclosure, a method of manufacturing an inductor may include: forming a first coil pattern and a coil connecting portion on a first insulator sheet; stacking a second insulator sheet on the first insulator sheet; forming a second coil pattern and a coil connecting portion on the second insulator sheet; stacking a third insulator sheet on the second insulator sheet; and repeatedly performing the stacking to form a body including a plurality of coil patterns, wherein first and second external electrodes connected to opposing ends of the plurality of coil patterns are disposed inside the body, and the first and second external electrodes are directly connected to opposing ends of the plurality of coil patterns inside the body.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
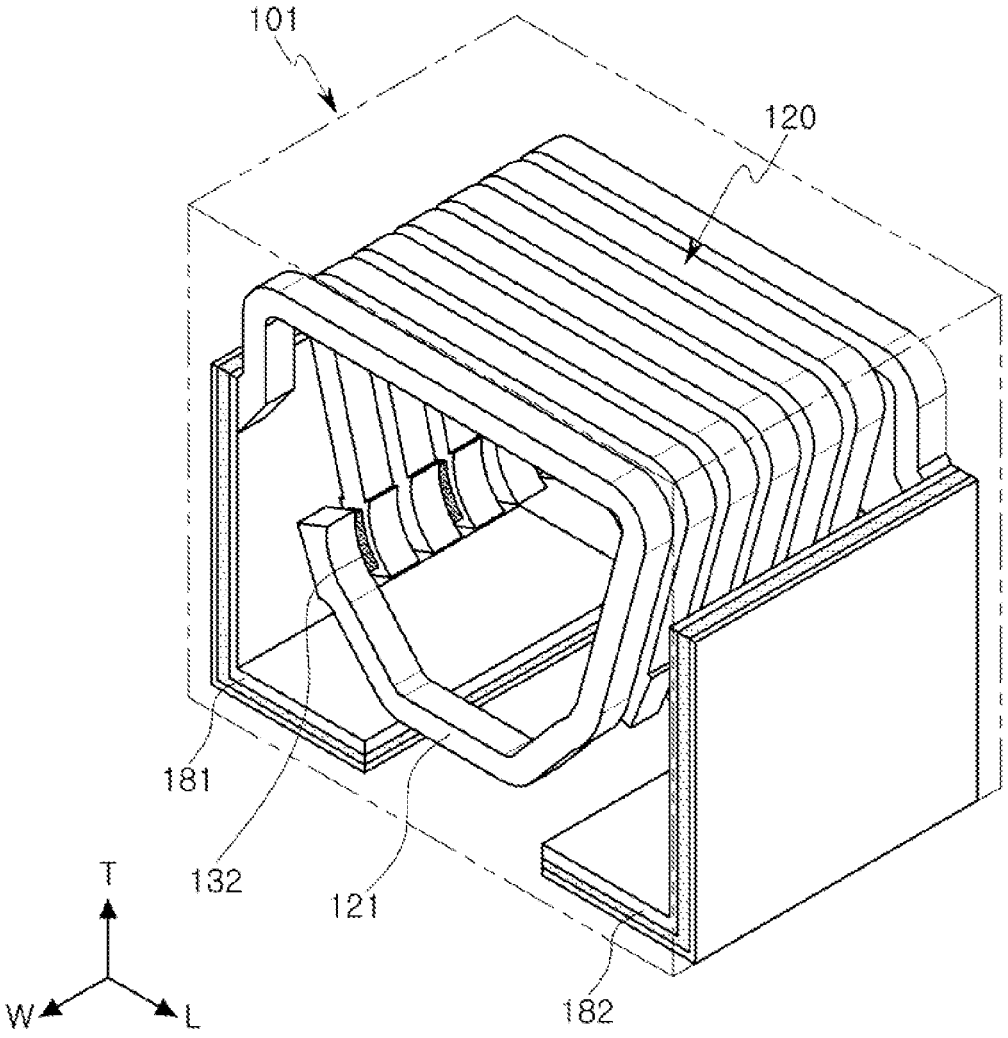
FIG. 1 is a schematic perspective view of an inductor according to an exemplary embodiment in the present disclosure.

Hereinafter, exemplary embodiments in the present disclosure will be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. In addition, a vertical direction refers to the abovementioned upward and downward directions, and a horizontal direction refers to a direction perpendicular to the abovementioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

FIG. 1 is a schematic perspective view of an inductor according to an exemplary embodiment in the present disclosure.

Figure 2:
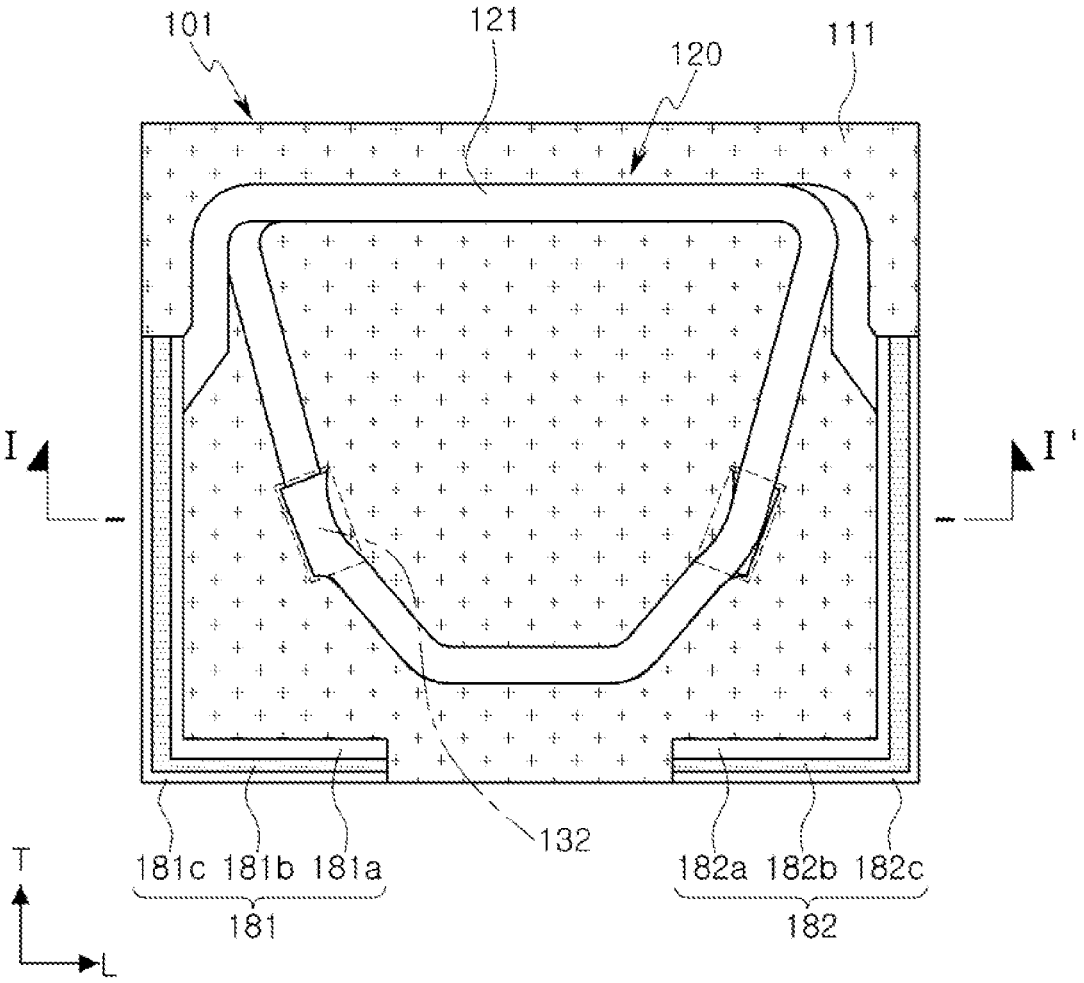
FIG. 2 is a schematic front view of the inductor of FIG. 1.

FIG. 2 is a front view of the inductor of FIG. 1, in the W direction.

Figure 3:
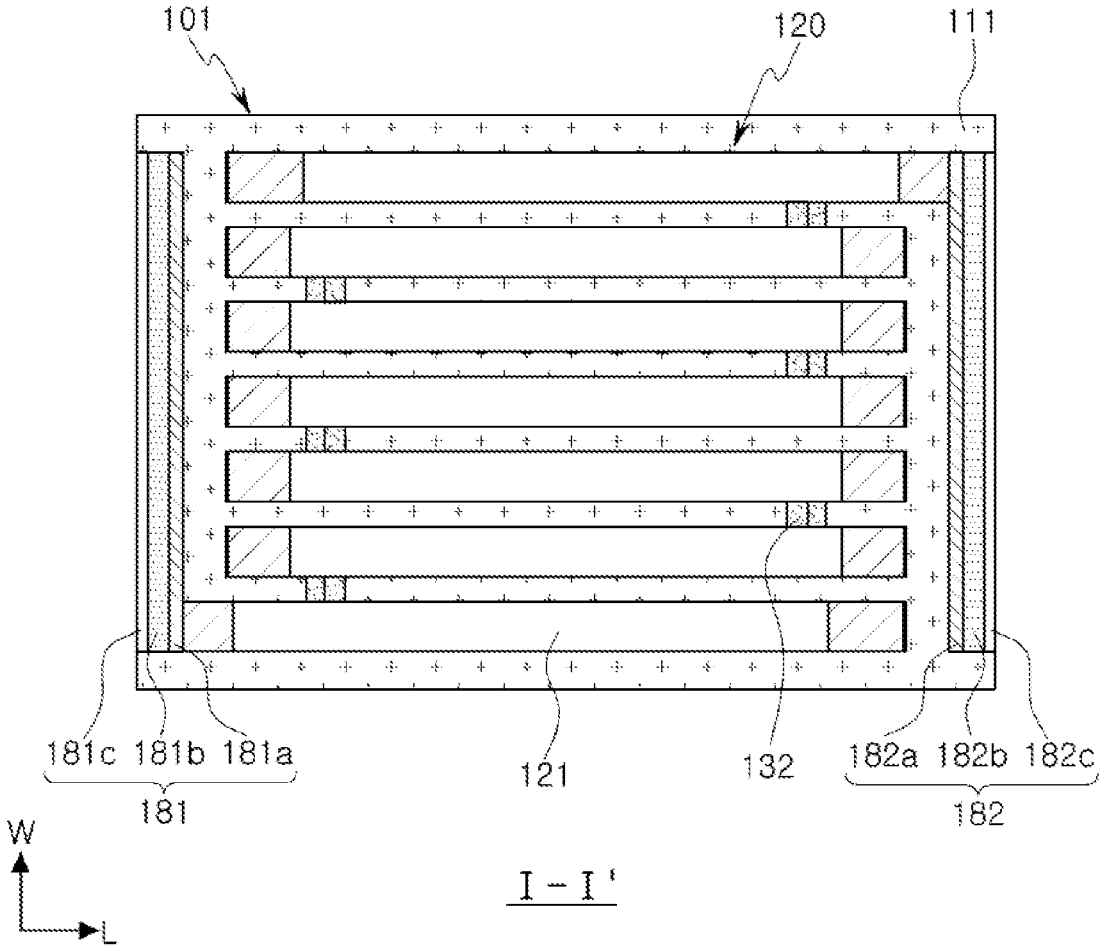
FIG. 3 is a schematic cross-sectional view taken along line I-I' of FIG. 2.

FIG. 3 is a cross-sectional view taken along line I-I' of FIG. 2.

A structure of an inductor 100 according to an exemplary embodiment in the present disclosure will be described with reference to FIGS. 1 through 3.

A body 101 of the inductor 100 according to an exemplary embodiment in the present disclosure may be formed by stacking a plurality of insulating layers 111 in a first direction horizontal to a mounting surface.

The insulating layer 111 may include $SiO_2$ powder. In another exemplary embodiment, the insulating layer 111 may include $Al_2O_3$ powder. In another exemplary embodiment, the insulating layer 111 may include aluminosilicate ($Al_2O_5Si$) powder. However, the present disclosure is not limited to these materials.

The insulating layer 111 may be formed to include the above-mentioned powder in a resin, or the like.

According to an exemplary embodiment in the present disclosure, first and second external electrodes 181 and 182 may be disposed inside the body 101.

For example, the first and second external electrodes 181 and 182 may be disposed on the mounting surface of the body 101. The mounting surface refers to a surface facing a printed circuit board (PCB) when the inductor is mounted on the PCB.

The external electrodes 181 and 182 serve to electrically connect the inductor 100 and the PCB when the inductor 100 is mounted on the PCB. The external electrodes 181 and 182 are disposed on the body 101 in the first direction and on the edges in a second direction horizontal to the mounting surface. The external electrodes 181 and 182 may include first electrode layers 181*a* and 182*a* and plating layers 181*b* and 181*c* and 182*b* and 182*c* formed on the first electrode layers 181*a* and 182*a*, respectively, but is not limited thereto.

The first electrode layers 181*a* and 182*a* may be directly connected to the plurality of coil patterns 121 and may be formed of the same material as that of the plurality of coil patterns 121. Specifically, first electrode layers 181*a* and 182*a* may include a conductive metal of at least one selected from the group consisting of copper (Cu), nickel (Ni), and silver (Ag).

The first and second external electrodes 181 and 182 may further include a plurality of plating layers 181*b*, 181*c*, 182*b*, and 182*c* disposed on the first electrode layers 181*a* and 182*a*.

The outermost plating layers 181*c* and 182*c*, among the plurality of plating layers 181*b*, 181*c*, 182*b*, and 182*c*, may be exposed to the outside of the body 101.

The plurality of plating layers 181*b*, 181*c*, 182*b*, and 182*c* may be sequentially formed in order of nickel (Ni) layers 181*b* and 182*b* and tin (Sn) layers 181*c* and 182*c*.

In the related art inductor, since the external electrodes are disposed on the external surface of the body, there is a problem in implementing a high inductance due to a reduction in volume of the body by the volume of the external electrode.

That is, in the related art, since the external electrodes are disposed on the external surface of the body, in the case of the "L"-shaped external electrodes, the body is not filled from the end of the external electrode on the side surface in the length direction to an upper surface of the body, which is disadvantageous to formation of inductance.

However, according to an exemplary embodiment in the present disclosure, since the first and second external electrodes 181 and 182 are disposed inside the body 101, there is no reduction in the volume of the body due to the external electrodes, realizing high inductance.

Referring to FIG. 2, when the first and second external electrodes 181 and 182 are disposed inside the body 101, it means that the body is filled from the ends of the first and second external electrodes 181 and 182 on the side surfaces in the length direction to the upper surface of the body when the first and second external electrodes 181 and 182 have the "L" shape.

It also means that interfaces of the ends of the first and second external electrodes 181 and 182 and the interface of an end surface of the body 101 in the length direction are substantially matched (or aligned).

Here the substantial matching of the interfaces of the ends of the first and second external electrodes 181 and 182 and the interface of the end surface of the body in the length direction includes accurate matching and a difference made in a predetermined portion due to a difference in terms of process.

In this case, as described later, the outermost plating layers 181*c* and 182*c* constituting the first and second external electrodes 181 and 182 may be exposed to the outside of the body.

Also, the outermost plating layers 181*c* and 182*c* constituting the first and second external electrodes 181 and 182 may protrude to the outside of the body or may be disposed on an inner side of the interface of the end surface of the body 101 in the length direction.

Referring to FIGS. 1 to 3, a coil pattern 121 may be formed on the insulating layer 111.

The coil pattern 121 may be electrically connected to an adjacent coil pattern 121 by a coil connecting portion 132. That is, helical coil patterns 121 are connected by the coil connecting portion 132 to form a coil 120.

Opposing ends of the coil 120 are directly connected to the first and second external electrodes 181 and 182, respectively.

In the related art inductor, since the external electrodes are disposed on the external surface of the body, coil lead portions must be separately formed at the opposing ends of the coil to connect the opposing ends of the coil and the external electrodes.

In contrast, according to an exemplary embodiment in the present disclosure, since the first and second external electrodes 181 and 182 are disposed inside the body 101, separate coil lead portions are not required for the opposing ends of the coil 120, and the opposing ends of the coil 120 are directly connected to the first and second external electrodes 181 and 182, respectively.

When the opposing ends of the coil 120 are directly connected to the first and second external electrodes 181 and 182 without using the separate coil lead portions as described above, an internal area of the coil may be increased by the area to be occupied by the coil lead portions.

Inductance of the inductor is proportional to the internal area of the coil when permeability, the number of turns of the coil, and a length of a magnetic path are equal.

That is, according to an exemplary embodiment in the present disclosure, since the opposing ends of the coil 120 are directly connected to the first and second external electrodes 181 and 182 without separate coil lead portions, the internal area of the coil may be increased by the area to be occupied by the coil lead portions, enhancing inductance of the inductor.

As illustrated in FIG. 2, in the inductor according to an exemplary embodiment in the present disclosure, since the opposing ends of the coil 120 are directly connected to the first and second external electrodes 181 and 182, respectively, without separate coil lead portions, the internal area of the coil is increased by about 23.8% as compared with the structure of the related art inductor in which the external electrodes and the coil are connected by the coil lead portions.

As described above, inductance of the inductor according to an exemplary embodiment in the present disclosure may be improved owing to the increase in the internal area of the coil.

According to another exemplary embodiment in the present disclosure, a height of the upper coil 120 may be increased by 8.2% with respect to the coil connecting portion 132, and in this case, an internal area of the coil may be increased by up to 32.3%. As a result, higher inductance may be obtained.

The coil connecting portion 132 may connect the coil patterns 121 and include a conductive via penetrating through the insulating layer 111.

As a material of the coil pattern 121 and the coil connecting portion 132, a conductive material such as copper (Cu), aluminum (Al), silver (Ag), tin (Sn), gold (Au), nickel (Ni), lead (Pb), or alloys thereof, which are metals having excellent conductivity, may be used. The coil patterns 121 and the coil connecting portion 132 may be formed by a plating method, a printing method, or the like.

As illustrated in FIG. 2, since the inductor 100 according to an exemplary embodiment in the present disclosure is formed by forming the coil pattern 121 or the coil connecting portion 132 on the insulating layer 111 and subsequently stacking the insulating layers 111 in the first direction horizontal to the mounting surface, the inductor 100 may be manufactured more easily than the related art inductor. In addition, since the coil patterns 121 are arranged to be perpendicular to the mounting surface, it is possible to prevent a magnetic flux from being affected by a mounting board.

Referring to FIGS. 2 and 3, in the coil 120 of the inductor 100 according to an exemplary embodiment in the present disclosure, the coil patterns 121 overlap to form a coil track having one or more number of coil turns when projected in the first direction.

Specifically, the first external electrode 181 and a first coil pattern 121 are directly connected, and thereafter, the coil patterns 121 are sequentially connected by the coil connecting portions 132.

A last coil pattern 121 is directly connected to the second external electrode 182 to form the coil 120.

FIGS. 4A through 4K are views schematically illustrating a process of a method of manufacturing the inductor of FIG. 1.

Referring to FIGS. 4A through 4K, a method of manufacturing an inductor 100 according to another exemplary embodiment in the present disclosure includes forming a first coil pattern and a coil connecting portion on a first insulator sheet, stacking a second insulator sheet on the first insulator sheet, forming a second coil pattern and a coil connecting portion on the second insulator sheet, stacking a third insulator sheet on the second insulator sheet, and repeatedly performing the stacking to form a body including a plurality of coil patterns, wherein first and second external electrodes connected to the opposing ends of the plurality of coil patterns are disposed inside the body, and the first and second external electrodes are directly connected to the opposing ends of the plurality of coil patterns inside the body.

Hereinafter, a method of manufacturing an inductor according to another exemplary embodiment in the present disclosure will be described, but the present disclosure is not limited thereto.

1. Preparing First Insulator Sheet

Figure 4A:
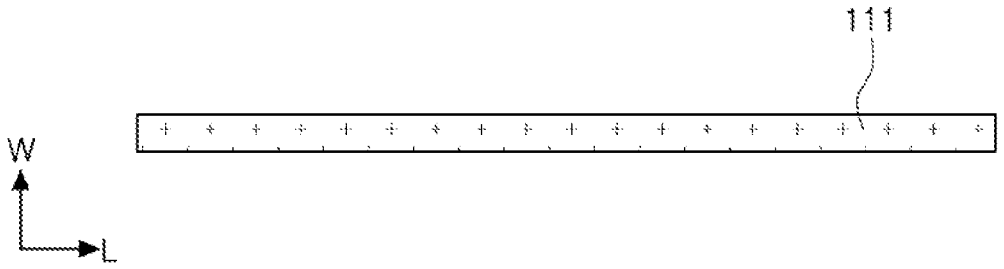
FIGS. 4A through 4K are views schematically illustrating a process of a method of manufacturing the inductor of FIG. 1.

As illustrated in FIG. 4A, a first insulator sheet 111 is prepared. The first insulator sheet 111 may include at least one of $SiO_2$ powder, $Al_2O_33$ powder, and aluminosilicate ($Al_2O_5Si$) powder. However, the present disclosure is not limited to these materials.

The first insulator sheet 111 may be formed by including the powder in a resin, or the like 2. Forming First Coil Pattern 121 and Coil Connecting Portion 132 on First Insulator Sheet 111

Figure 4B:
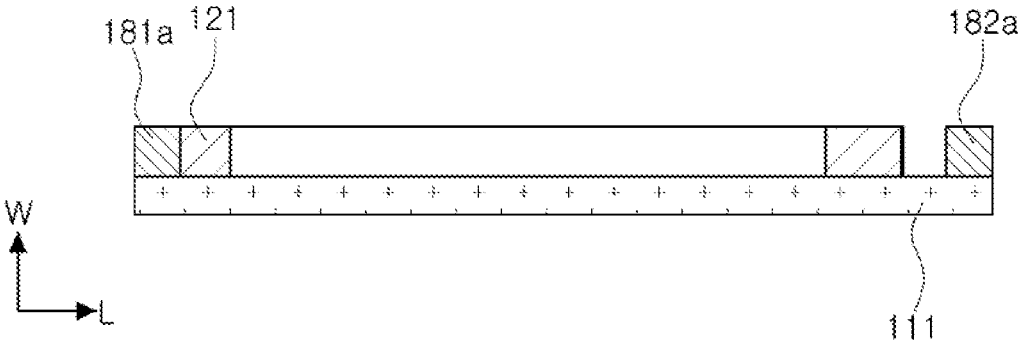
Figure 4C:
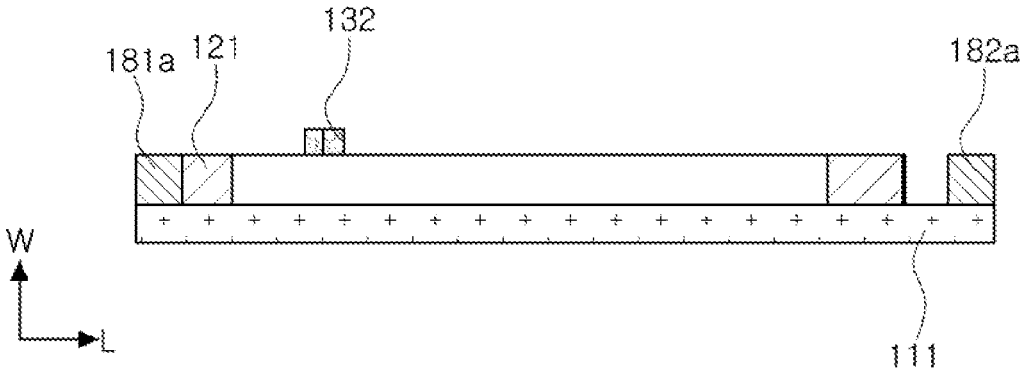

As illustrated in FIGS. 4B and 4C, a first coil pattern 121 is formed on the first insulator sheet 111 and a coil connecting portion 132 is formed on the coil pattern 121.

The method of forming the first coil pattern and the coil connecting portion is performed by a printing method using a mask, and the first coil pattern and the coil connecting portion are formed of a metal.

3. Stacking Second Insulator Sheet on First Insulator Sheet

Figure 4D:
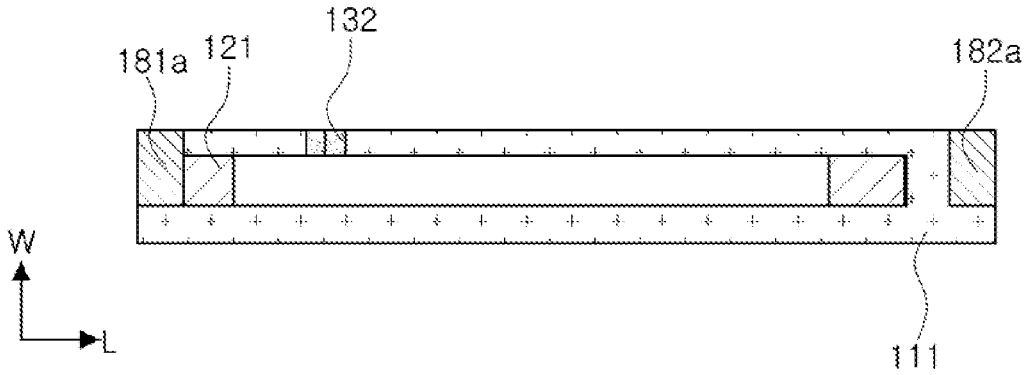

As illustrated in FIG. 4D, a second insulator sheet is stacked on the first insulator sheet.

The method of stacking the second insulator sheet on the first insulator sheet is not limited and may be carried out by the related art method.

4. Forming Second Coil Pattern and Coil Connecting Portion on Second Insulator Sheet.

Figure 4E:
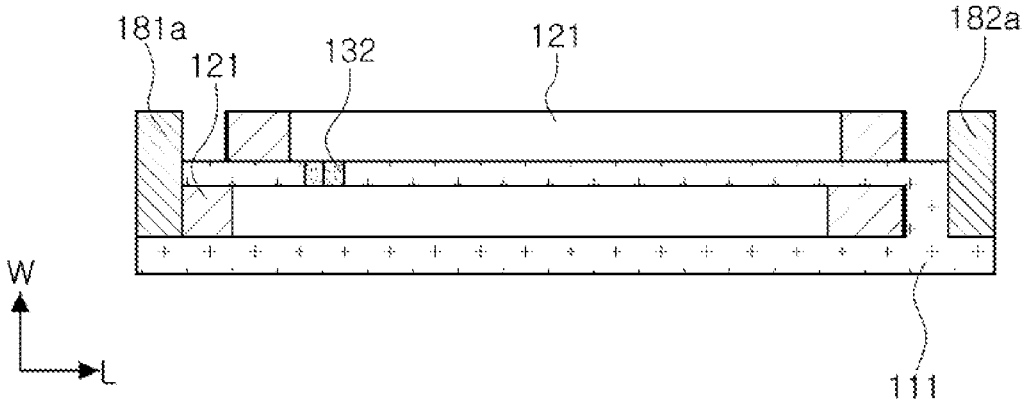
Figure 4F:
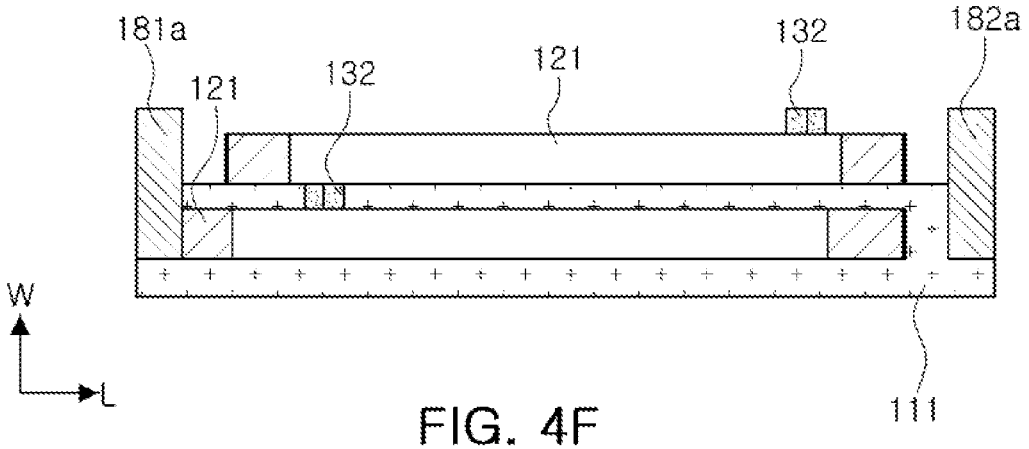

As illustrated in FIGS. 4E and 4F, a second coil pattern and a coil connecting portion are formed on the second insulator sheet.

The method of forming the second coil pattern and the coil connecting portion is performed by a printing method using a mask, and the second coil pattern and the coil connecting portion are formed of a metal.

5. Stacking Third Insulator Sheet on Second Insulator Sheet

Figure 4G:
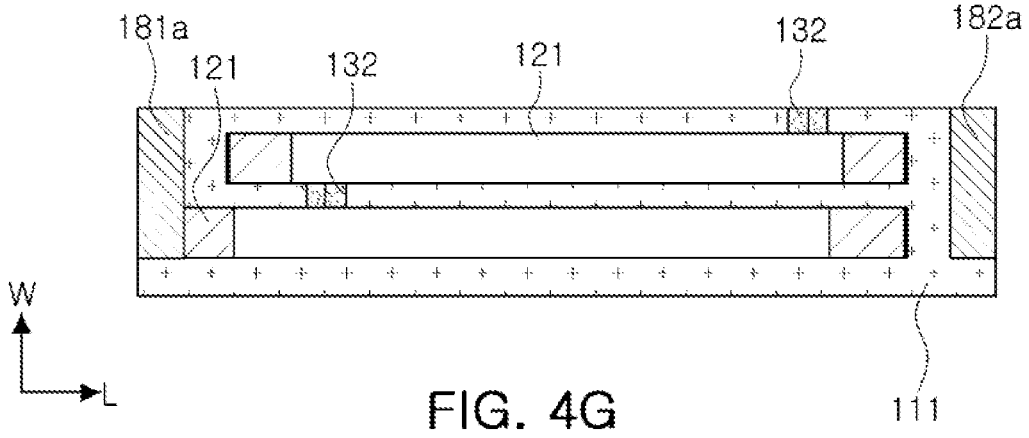

As illustrated in FIG. 4G, a third insulator sheet is deposited on the second insulator sheet.

The method of stacking the third insulator sheet on the second insulator sheet may be performed in the same manner as the method of stacking the second insulator sheet on the first insulator sheet.

Figure 4H:
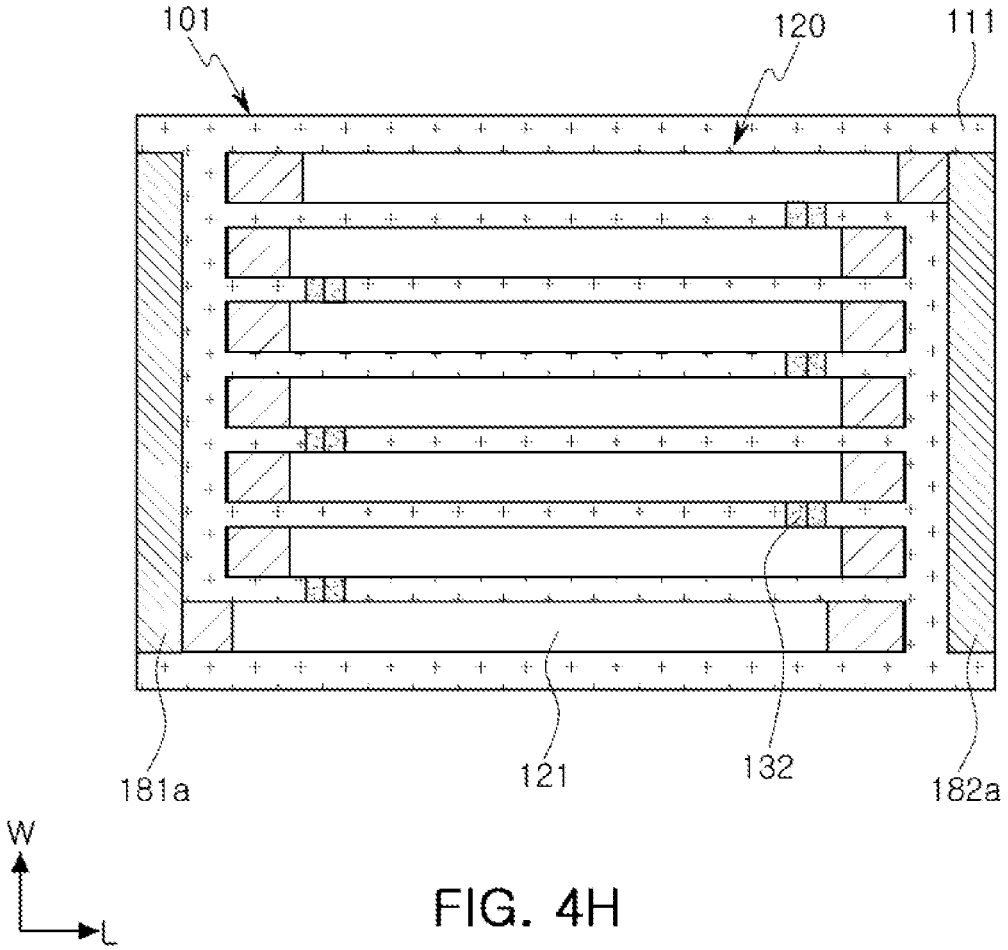

6. Performing Stacking by Repeating the Above Process to Form Body Including a Plurality of Coil Patterns As illustrated in FIG. 4H, by repeating the above steps, a body including a plurality of coil patterns is formed.

Figure 4I:
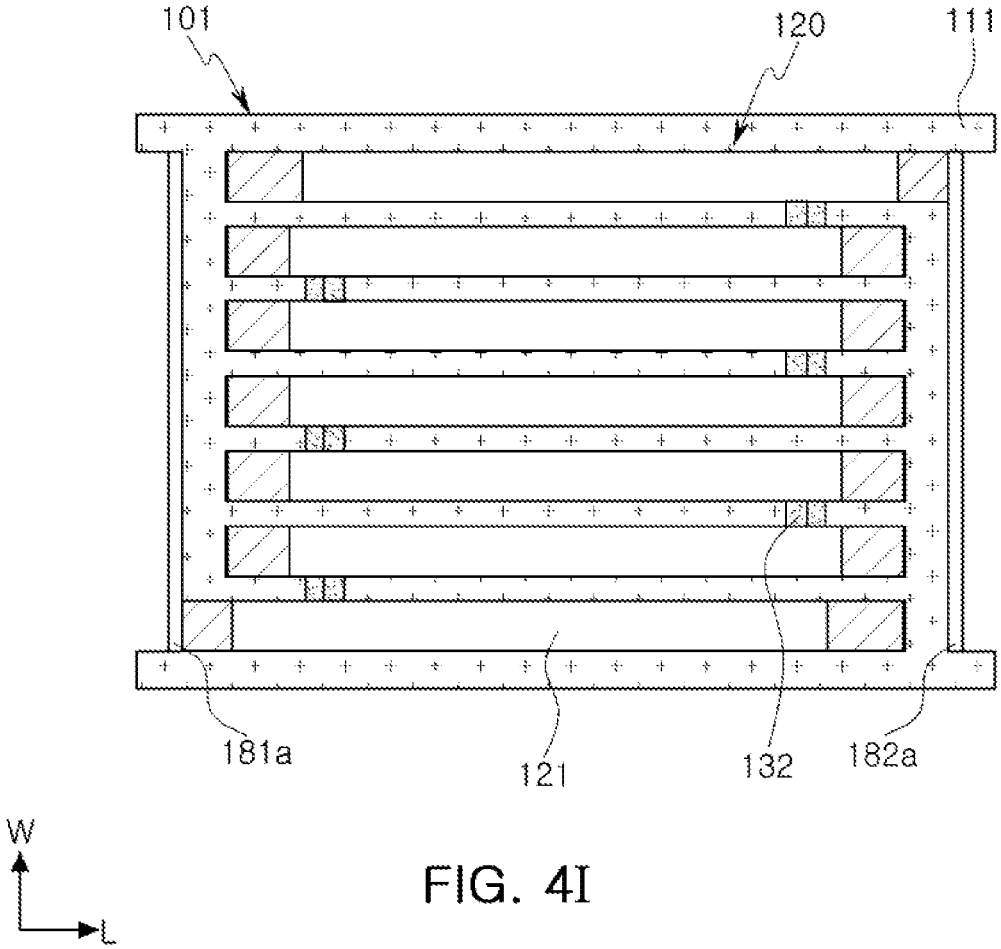

7. Etching First Electrode Layers 181*a* and 182*a* Exposed to Interfaces of Body As illustrated in FIG. 4I, the first electrode layers 181*a* and 182*a* exposed to the interfaces of the body are etched.

8. Forming Nickel (Ni) and Tin (Sn) Plating Layers on First Electrode Layers 181*a* and 182*a*

Figure 4J:
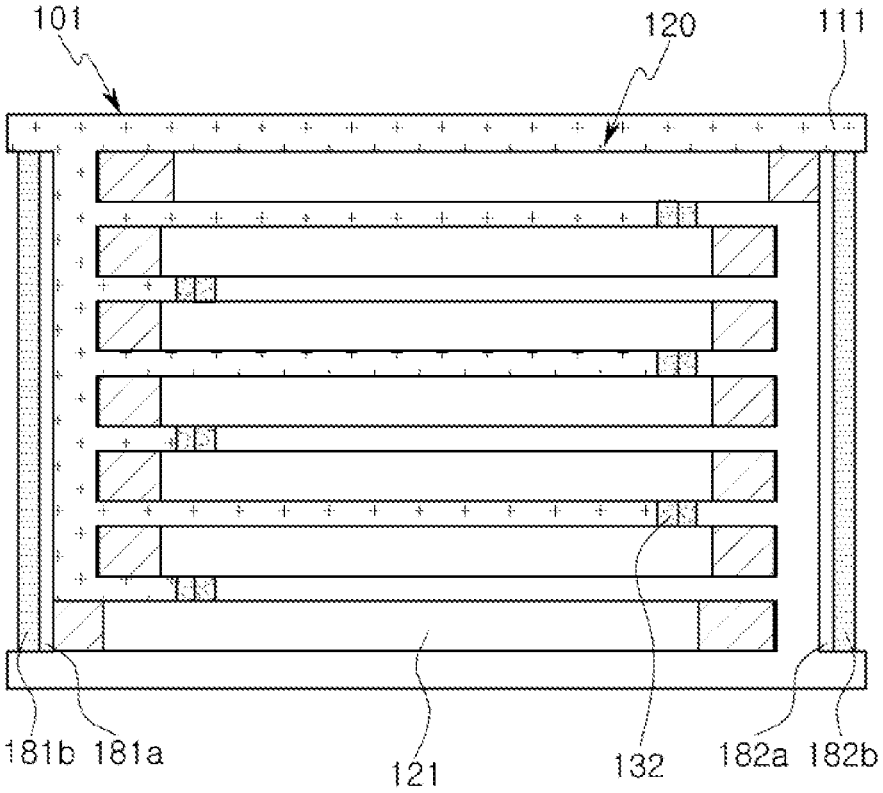
Figure 4J:
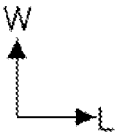
Figure 4K:
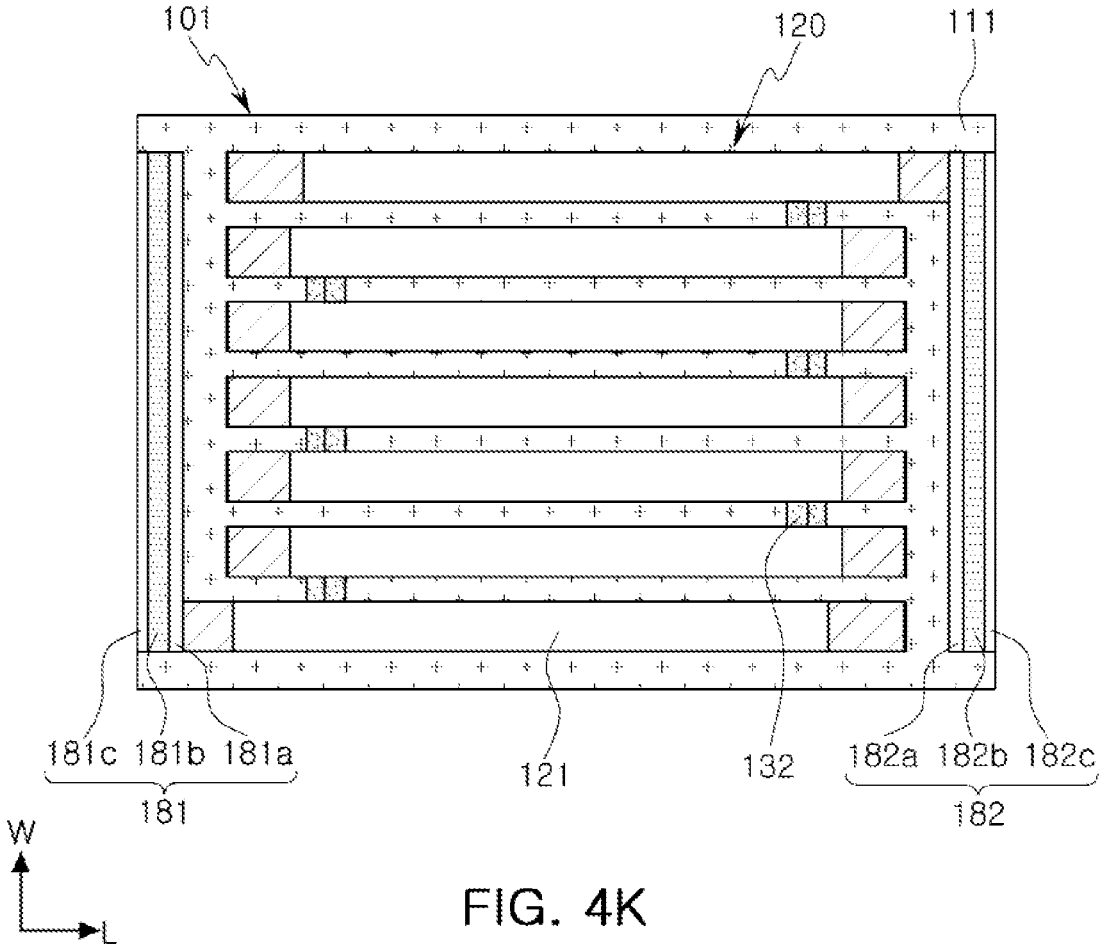

As illustrated in FIGS. 4J and 4K, nickel (Ni) and tin (Sn) plating layers 181*b*, 181*c*, 182*b*, and 182*c* are formed on the first electrode layers 181*a* and 182*a*.

Through formation as described above, an inductor in which the first and second external electrodes 181 and 182 connected to the opposing ends of the plurality of coil patterns 121 are further disposed inside the body 101, and the external electrodes 181 and 182 are directly connected to the opposing ends of the plurality of coil patterns 121 inside the body 101 may be manufactured.

The interfaces at the ends of the first and second external electrodes 181 and 182 in the length direction of the body 101 and an interface at an end surface of the body 101 in the length direction may be substantially matched.

The substantial matching between the interfaces at the ends of the first and second external electrodes 181 and 182 and the interface at the end surface of the body 101 in the length direction includes accurate matching and may also include a difference in a predetermined portion due to a difference in terms of process.

In this case, the outermost plating layers 181*c* and 182*c* constituting the first and second external electrodes 181 and 182 may be exposed to the outside of the body.

The outermost plating layers 181*c* and 182*c* constituting the first and second external electrodes 181 and 182 may protrude to the outside of the body or may be disposed on an inner side of the interfaces at the end surfaces of the body 101 in the length direction.

In the inductor according to another exemplary embodiment in the present disclosure, a detailed description of the same characteristics as those of the inductor according to the above-described exemplary embodiment in the present disclosure will be omitted.

As set forth above, in the inductor according to exemplary embodiments of the present disclosure, since the first and second external electrodes are disposed inside the body, there is no reduction in the volume of the body due to the external electrodes, and thus, high inductance may be realized.

In addition, since the opposing ends of the coil are directly connected to the first and second external electrodes without separate coil lead portions, the internal area of the coil may be increased by the area to be occupied by the coil lead portions, and thus, inductance of the inductor may be improved.

While exemplary embodiments have been shown and described above, it will be apparent to those skilled in the art that modifications and variations could be made without departing from the scope of the present disclosure as defined by the appended claims.

What is claimed is:

1. An inductor comprising:

a body having a mounting surface, the mounting surface being an external surface along a thickness of the body, and plurality of insulating layers stacked in a width direction;

a plurality of coil patterns disposed on the plurality of insulating layers, each enclosing a portion of a corresponding of the plurality of insulating layers; and first and second external electrodes, each comprising a plurality of plating layers, disposed inside the body, wherein the first and second external electrodes are exposed through the mounting surface and spaced apart from each other along the mounting surface, wherein the plurality of coil patterns are connected by coil connecting portions and form a coil in which opposing ends thereof are connected to the first and second external electrodes, and the first and second external electrodes are directly connected to the opposing ends of the coil inside the body, wherein a distance between farthest inner edges of each of the plurality of coil patterns reduces along the thickness direction closer to the mounting surface, and wherein an outermost surface of the first and second external electrodes is spaced inwardly apart from corresponding side surfaces of the body, forming an inwardly concave step between the outermost surface of the first and second external electrodes and the corresponding side surfaces of the body.

2. The inductor of claim 1, wherein the first and second external electrodes are directly connected to the plurality of coil patterns and include a first electrode layer deposited with the same material as that of the plurality of coil patterns.

3. The inductor of claim 2, wherein the first and second external electrodes further include a plurality of plating layers disposed on the first electrode layer.

4. The inductor of claim 3, wherein an outermost plating layer among the plurality of plating layers is exposed to the outside of the body.

5. The inductor of claim 1, wherein a width of the plurality of coil patterns where the connecting portions are disposed is substantially same as the width of a remainder of the plurality of coil patterns.

6. The inductor of claim 1, wherein the connecting patterns and the patterns overlap each other along substantially a same axis.

7. An inductor comprising:

a body including a stack of a first insulating layer, a last insulating layer and intermediate insulating layers, stacked along a width direction, each of the intermediate layers having a pattern disposed thereon, each of the patterns on the intermediate insulating layers being connected to the patterns on immediately adjacent insulating layers by a connecting pattern disposed on opposing ends of corresponding patterns, the patterns and the connecting patterns together comprising a coil disposed inside the body such that the patterns on the first and the last insulating layers form opposing ends of the coil, the patterns being spaced apart from a mounting surface, the mounting surface being an external surface of the body in a thickness direction; and first and second external electrodes disposed to be spaced apart along the mounting surface inside the body and directly connected respectively to the opposing ends of the coil, wherein an outermost surface of the first and second external electrodes is spaced inwardly apart from corresponding side surfaces of the body, forming an inwardly concave step between the outermost surface of the first and second external electrodes and the corresponding side surfaces of the body, and wherein the patterns are shaped to be tapering in the thickness direction towards the mounting surface.

8. The inductor of claim 7, wherein the first and second external electrodes include a first electrode layer formed of a same material as that of the patterns on the first, last and intermediate insulating layers.

9. The inductor of claim 8, wherein each of the first and second external electrodes further includes a plating layer disposed on the first electrode layer, the plating layer being exposed to an outside surface of the body.

10. The inductor of claim 7, wherein an external surface of each of the first and second external electrodes substantially matches an external surface of the body.

11. The inductor of claim 7, wherein the pattern on the first insulating layer is spaced apart from the second external electrode, the pattern on the last insulating layer is spaced apart from the first external electrode, and the patterns on intermediate insulating layers are spaced apart from both the first and second external electrodes.

12. The inductor of claim 7, wherein a width of the plurality of coil patterns where the connecting portions are disposed is substantially same as the width of a remainder of the plurality of coil patterns.

13. The inductor of claim 7, wherein each of the first and second external electrodes comprises a plurality of plating layers.

14. An inductor comprising:

a body in which a plurality of insulating layers on which a plurality of coil patterns are arranged are stacked along a width direction of the body, the body having a mounting surface, the mounting surface being an external surface of the body in a thickness direction; and first and second external electrodes disposed to be spaced apart along the mounting surface inside the body, wherein the plurality of coil patterns are connected by coil connecting portions and form a coil in which opposing ends thereof are connected to the first and second external electrodes, and the first and second external electrodes are directly connected to the opposing ends of the coil inside the body, wherein outlines of coil patterns including the opposing ends overlap each other in a direction in which the plurality of insulating layers are stacked, wherein a shortest distance between an outer edge of the plurality of coil patterns and an external surface of the body in a length direction increases in the thickness direction closer to the mounting surface, and wherein an outermost surface of the first and second external electrodes is spaced inwardly apart from corresponding side surfaces of the body, forming an inwardly concave step between the outermost surface of the first and second external electrodes and the corresponding side surfaces of the body.

15. The inductor of claim 14, wherein each of the first and second external electrodes comprises a plurality of plating layers.

* * * * *